US010941998B1

(12) United States Patent
Fan

(10) Patent No.: US 10,941,998 B1
(45) Date of Patent: Mar. 9, 2021

(54) FIREARM HAVING AN INTEGRAL COMPENSATOR

(71) Applicant: Jason Fan, Henderson, NV (US)

(72) Inventor: Jason Fan, Henderson, NV (US)

( * ) Notice: Subject to any disclaimer, the term of this patent is extended or adjusted under 35 U.S.C. 154(b) by 0 days.

(21) Appl. No.: 16/211,069

(22) Filed: Dec. 5, 2018

Related U.S. Application Data

(63) Continuation-in-part of application No. 16/039,212, filed on Jul. 18, 2018.

(60) Provisional application No. 62/688,967, filed on Jun. 22, 2018.

(51) Int. Cl.
*F41A 21/36* (2006.01)
*F41A 21/28* (2006.01)

(52) U.S. Cl.
CPC ..... *F41A 21/36* (2013.01); *F41A 21/28* (2013.01)

(58) Field of Classification Search
CPC .. F41A 21/28; F41A 21/36; F41A 5/04; F41A 25/22
See application file for complete search history.

(56) References Cited

U.S. PATENT DOCUMENTS

| | | | | | |
|---|---|---|---|---|---|
| 5,123,328 | A * | 6/1992 | Schuemann | F41A 21/28 | 89/14.3 |
| 5,423,242 | A * | 6/1995 | Schuemann | F41A 21/28 | 89/14.3 |
| 5,549,030 | A * | 8/1996 | Lespron | F41A 21/36 | 89/14.3 |
| 5,563,362 | A * | 10/1996 | York | F41A 21/36 | 89/14.3 |
| 5,969,285 | A * | 10/1999 | Krebs | F41A 21/488 | 89/163 |
| 9,970,727 | B2 * | 5/2018 | Niswander | F41A 21/36 | |
| 10,156,412 | B1 * | 12/2018 | Price | F41A 21/36 | |
| 10,180,300 | B2 * | 1/2019 | Schirmer | F41A 21/36 | |
| 2018/0347933 | A1 * | 12/2018 | Molina | F41A 35/04 | |
| 2019/0011209 | A1 * | 1/2019 | Chavez | F41A 21/36 | |

* cited by examiner

*Primary Examiner* — Joshua T Semick
(74) *Attorney, Agent, or Firm* — FisherBroyles, LLP; Rob L. Phillips

(57) ABSTRACT

A Glock compensator integral with a barrel, and a slide assembly allow escaping gases to dampen recoil associated with firing a Glock firearm. The Glock barrel is removed from the front of the firearm allowing for the integrated compensator at the front of the firearm. Various features, including a lock design, debris port, swept back side ports, height offset, nose ring design and mass-reducing rear cutout, result in an efficient and effective integrated compensator suitable for $4^{th}$ and $5^{th}$ generation Glock firearms. The compensator and barrel may be fabricated from the same piece of billet. A pair of side rails may be positioned and configured to slidably receive a slide assembly.

3 Claims, 13 Drawing Sheets

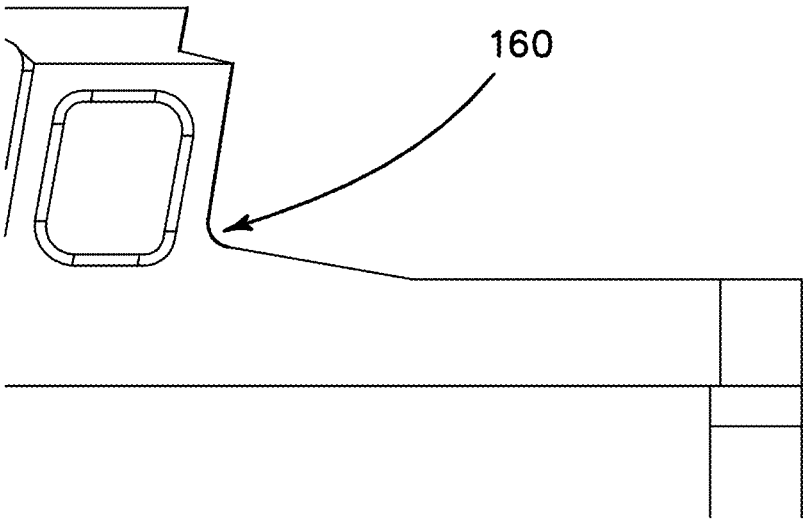
FIG. 4A
FIG. 4B
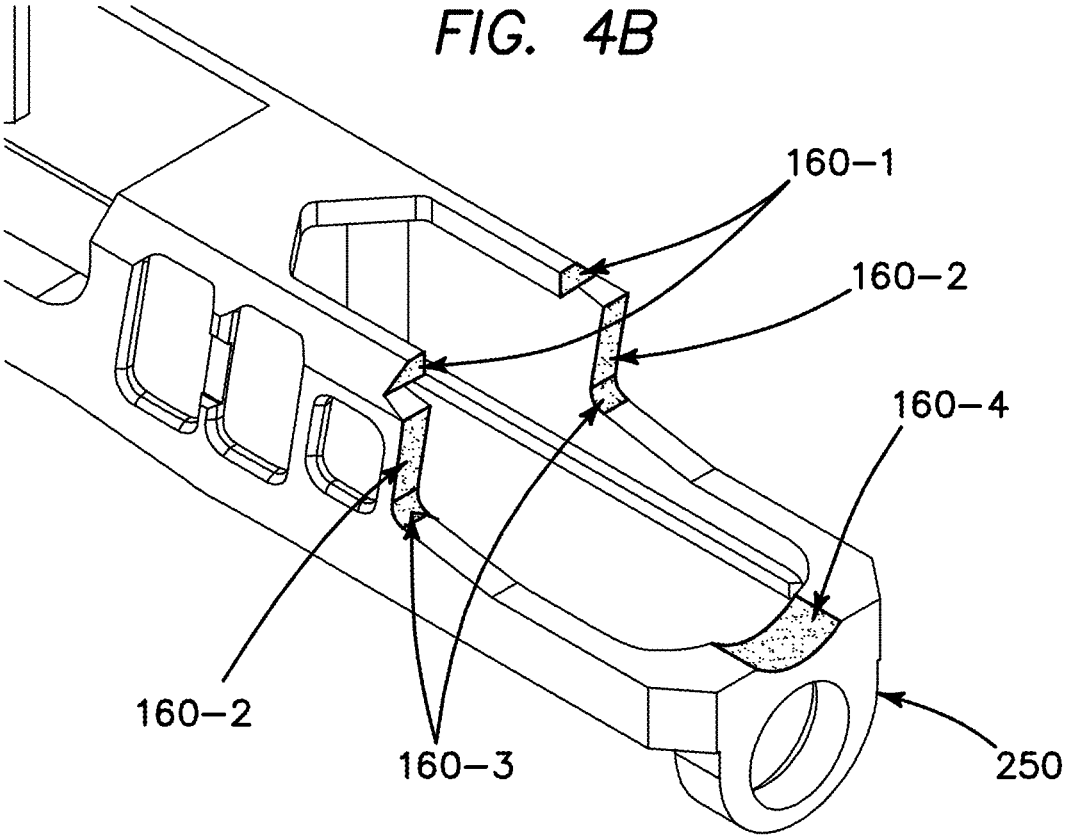

FIREARM HAVING AN INTEGRAL COMPENSATOR

CROSS-REFERENCE

This application claims priority to U.S. patent application Ser. No. 16/039,212 filed Jul. 17, 2018 which claims priority to U.S. Patent Application No. 62/688,967 filed Jun. 22, 2018 which are both incorporated herein for all purposes.

FIELD OF THE INVENTION

The embodiments of the present invention relate to a compensator for a firearm. More specifically, an integrated compensator for a Glock handgun.

BACKGROUND

Firearm compensators counter the vertical movement of a gun barrel responsive to firing. Upon firing, handguns recoil such that the muzzle climbs vertically. Compensators act to vent gases upward from the gun barrel in a direction opposite to the recoil. In this manner, the vented gases dampen the recoil of the firearm. Many firearm compensators attach to the muzzle end of the firearm. Glock firearms have a barrel that is removed from the rear of the firearm reducing the ability to attach compensators to the muzzle area of the firearm.

It would be advantageous to develop an integrated compensator for a family of handguns (e.g., Glock) that is more efficient and effective at dampening the recoil associated with firing of the handgun and eliminates the concern and drawbacks relative to attaching compensators to the muzzle end of the firearm.

SUMMARY

Accordingly, a first embodiment of the present invention comprises a firearm having a compensator and barrel combination; a slide assembly; said compensator and barrel combination allowing escaping gases to dampen recoil associated with firing said firearm, said compensator and barrel combination comprising one or more of the following: a lock design, debris port, swept back side ports, height offset, nose ring design and mass-reducing rear cutout. In this embodiment, the Glock barrel is removed from the front of the firearm allowing for the integral compensator at the front of the firearm. Various features, including a lock design, debris port, swept back side ports, height offset, nose ring design and mass-reducing rear cutout, result in an efficient and effective integrated compensator suitable for $4^{th}$ and $5^{th}$ generation Glock firearms.

Another embodiment comprises a slide assembly, a compensator and barrel combination removably attached to said slide assembly wherein said compensator includes a pair of spaced longitudinal rails having an upper surface positioned and configured to slidably contact portions of said slide assembly.

Other variations, embodiments and features of the present invention will become evident from the following detailed description, drawings and claims.

BRIEF DESCRIPTION OF THE DRAWINGS

FIGS. 4A and 4B illustrate a side view of a slide and barrel/compensator interface according to the embodiments of the present invention;

DETAILED DESCRIPTION

Figure 1A:
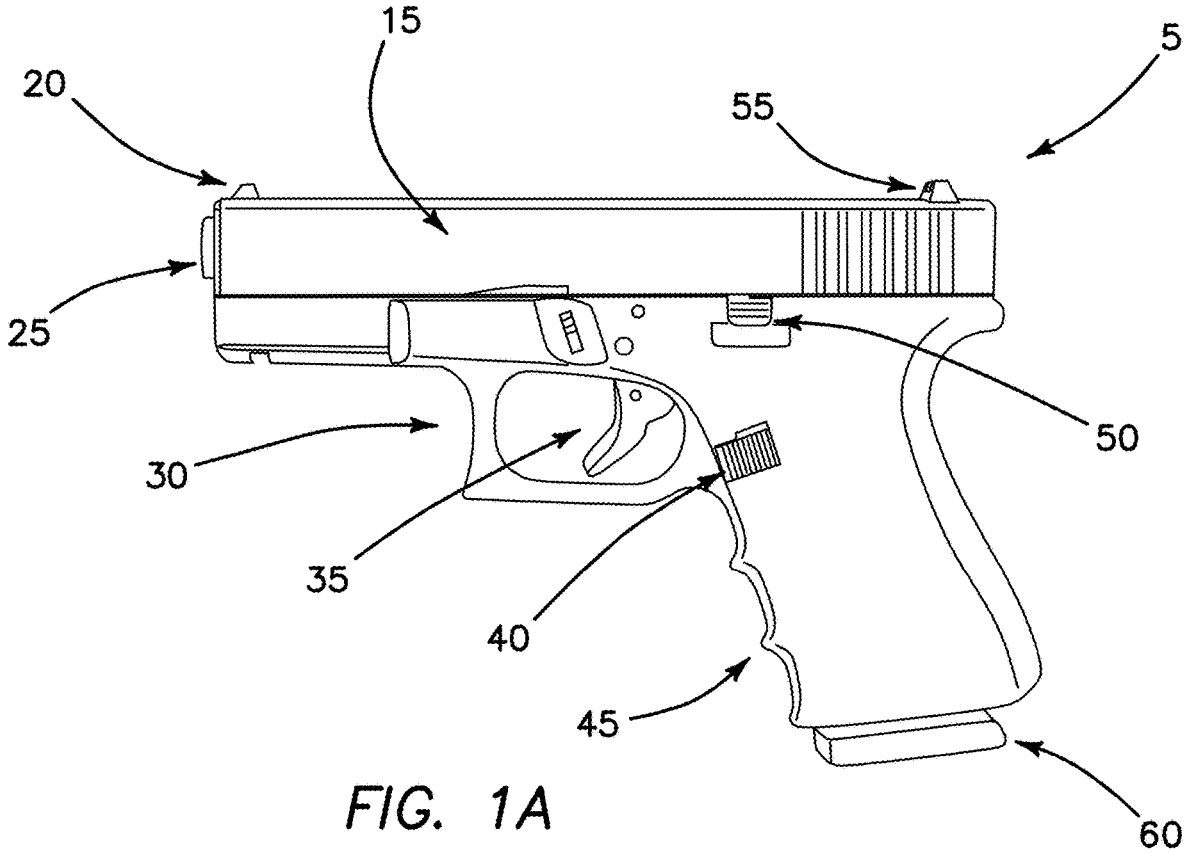
FIGS. 1A and 1B illustrates generation 4 and 5 Glock firearms, respectively.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The components of the present invention may be made using any suitable materials including, but not limited to, alloys, composites, metals, polymers, ceramics, plastics and combinations thereof. The components of the present invention may be fabricated using any suitable technique including, but not limited to, milling, machining, molding, 3D printing and combinations thereof.

Figure 1B:
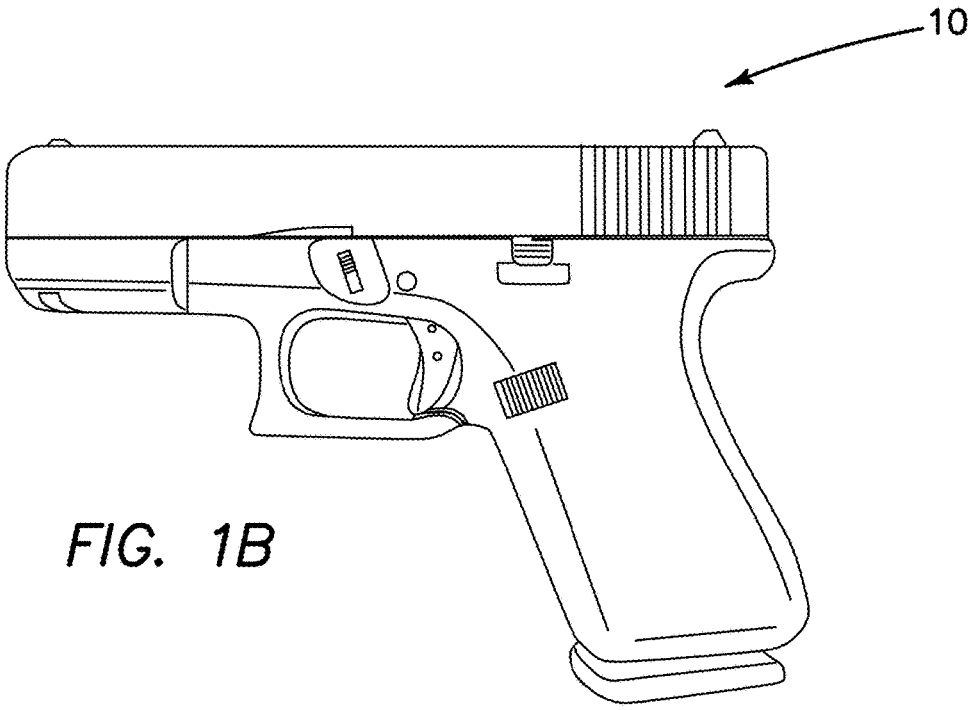

FIGS. 1A and 1B show generation 4 and 5 Glock firearms 5, 10 of the type with which the embodiments of the present invention may be used. FIG. 1A also depicts the basic parts of a handgun comprising the slide 15, front sight 20, barrel 25, trigger guard 30, trigger 35, magazine release 40, frame/grip 45, slide lock 50 and rear sight 55. A magazine 60 is inserted into the grip 45 in a conventional manner.

Figure 2:
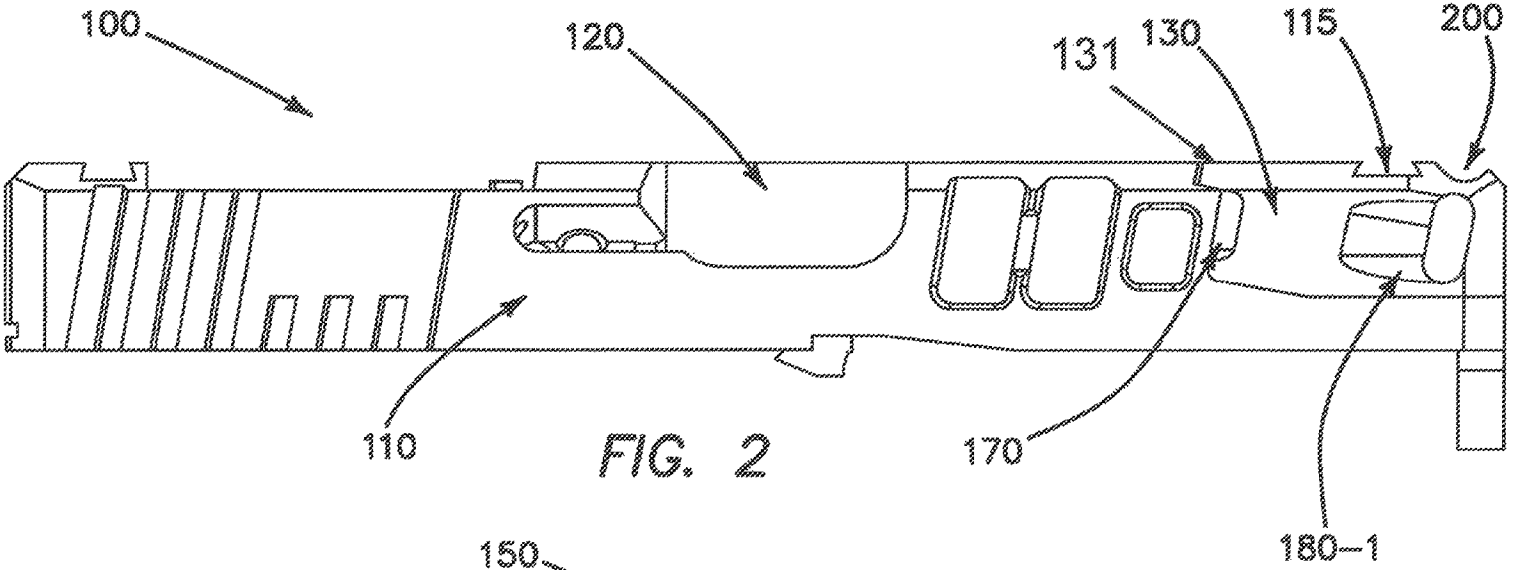
FIG. 2 illustrates a side view of a slide and barrel assembly having an integrated compensator according to the embodiments of the present invention.

FIG. 2 shows a side view of a slide and barrel assembly 100 having an integrated compensator according to the embodiments of the present invention. In broad terms, the slide and barrel assembly 100 includes a slide 110, barrel 120 and compensator 130 (upper surface 131) with the barrel 120 and compensator 130 being a single unit. In this embodiment, the barrel 120 is removed via the front of the slide 110 allowing for the integration of the compensator 130. In one embodiment, the compensator 130 is manufactured from the same piece of billet as the barrel 120 hence a single unit. Alternatively, the compensator 130 and barrel 120 may be separate pieces. A front sight dovetail 115 in the compensator 130 accepts a front sight for the firearm.

Figure 3:
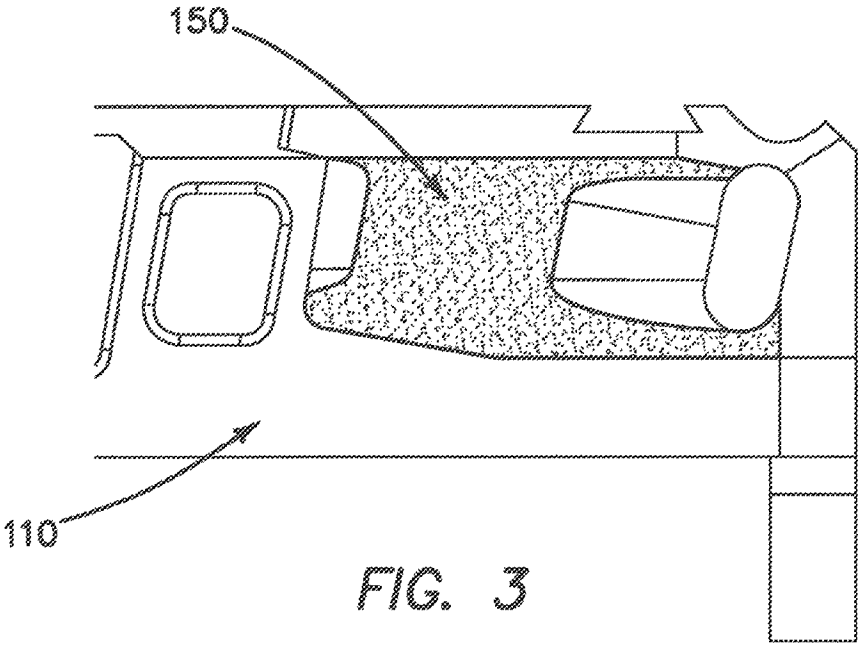
FIG. 3 illustrates a side view of a locking design according to the embodiments of the present invention.

FIG. 3 shows a side view of a locking design 150 according to the embodiments of the present invention. As shown, the compensator 130 mechanically locks up to the slide 110 based on an angled relationship between the two.

FIGS. 4A and 4B show a side view of a slide and barrel/compensator interface 160 according to the embodiments of the present invention. As shown, the interface 160 comprises various points of contact between the slide 110 and barrel 120 (not shown in FIGS. 4A and 4B). A first point of contact 160-1 is near a top portion of the slide 110; a second point of contact 160-2 is at a top and bottom of an intermediary vertical portion of the slide 110; a third point of contact 160-3 is below the intermediary portion of the slide 110 and angling forward; and a fourth point of contact 160-4 is at a front of the slide 110 above the nose ring 250.

Figure 5A:
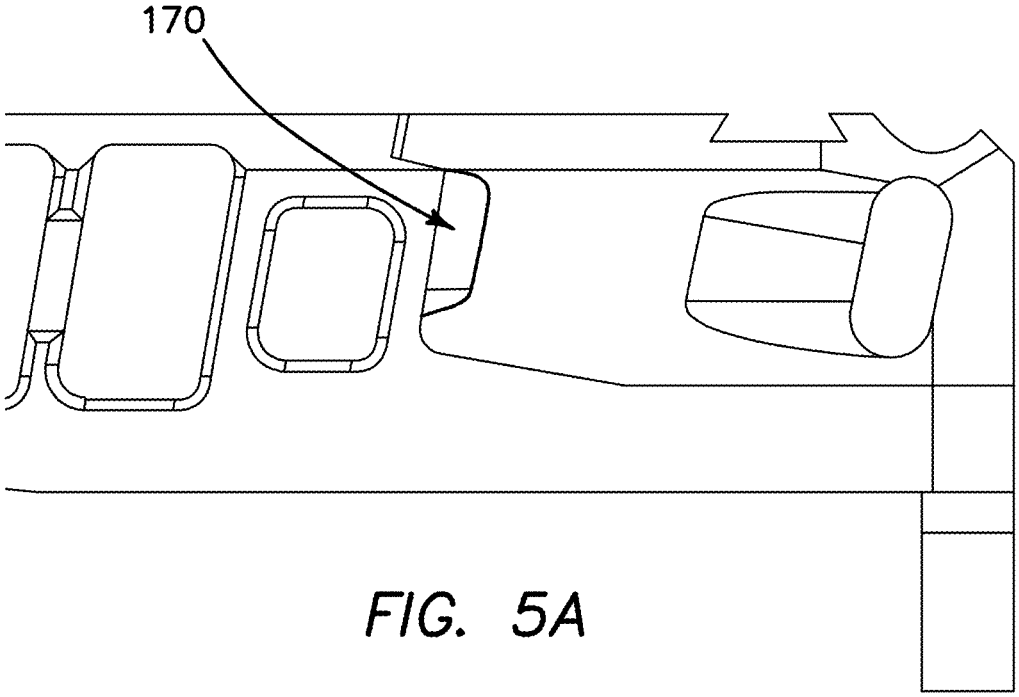
FIGS. 5A and 5B illustrate views of a cutout near an interface of the barrel and slide according to the embodiments of the present invention.
Figure 5B:
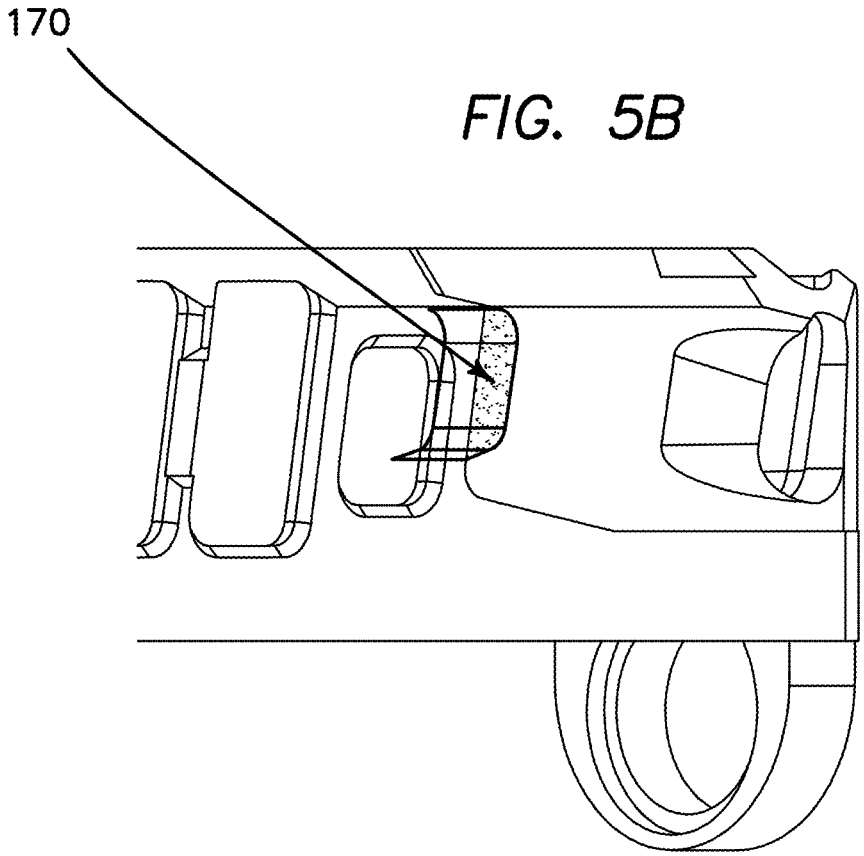

FIGS. 5A and 5B show views of a cutout 170 near the interface of the barrel 120 and slide 110 according to the embodiments of the present invention. The cutout 170 permits debris to escape. The cutout 170 also functions to eliminate any pinching effect on the user as the barrel 120 and slide 110 separate slightly during firing. While only one cutout 170 is shown, an identical cutout is positioned on the opposite side of the firearm.

Figure 6A:
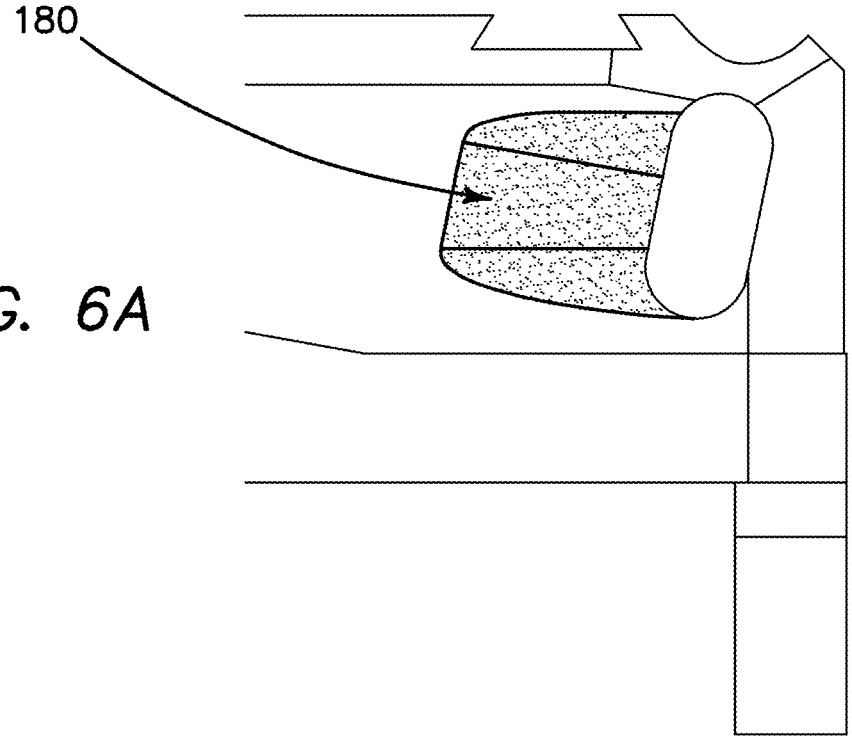
FIGS. 6A and 6B illustrate views of a swept back side compensator port according to the embodiments of the present invention.
Figure 6B:
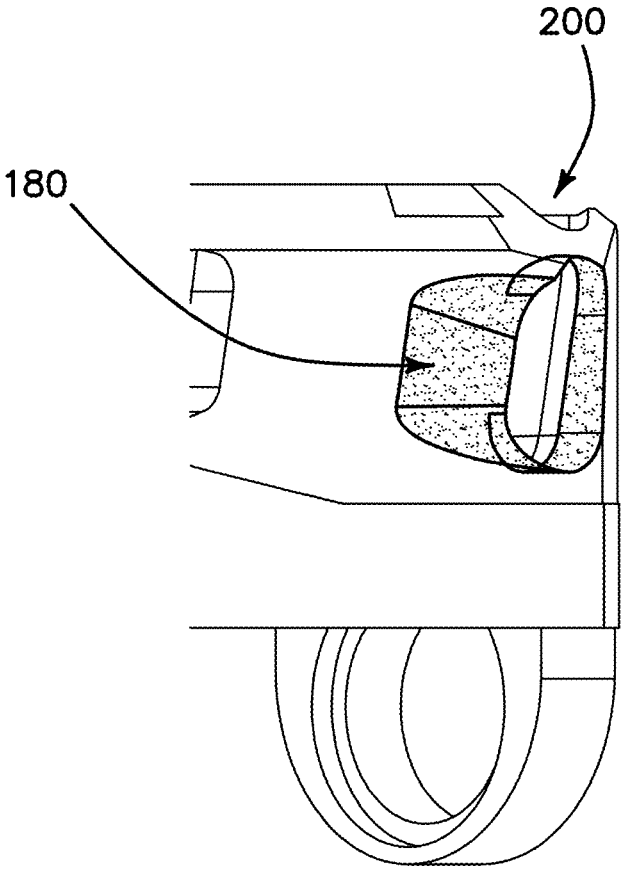

FIGS. 6A and 6B show views of a swept back side compensator port 180-1 (port 180-2 is visible in FIG. 8A albeit the swept back portion is not visible) according to the embodiments of the present invention. The swept back nature of the compensator ports 180-1, 180-2 forces gases rearward thereby dampening rearward recoil.

Figure 7A:
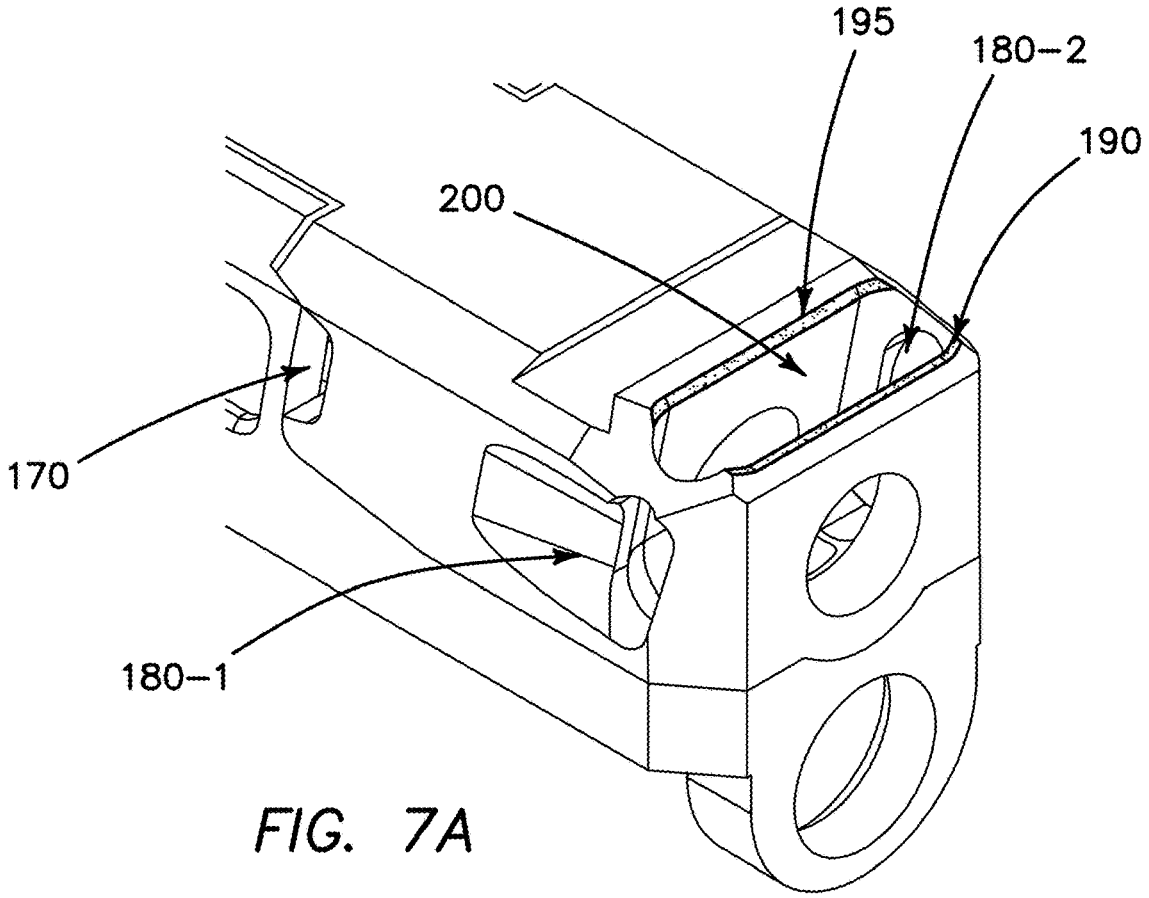
FIGS. 7A and 7B illustrate views of a compensator height offset according to the embodiments of the present invention.
Figure 7B:
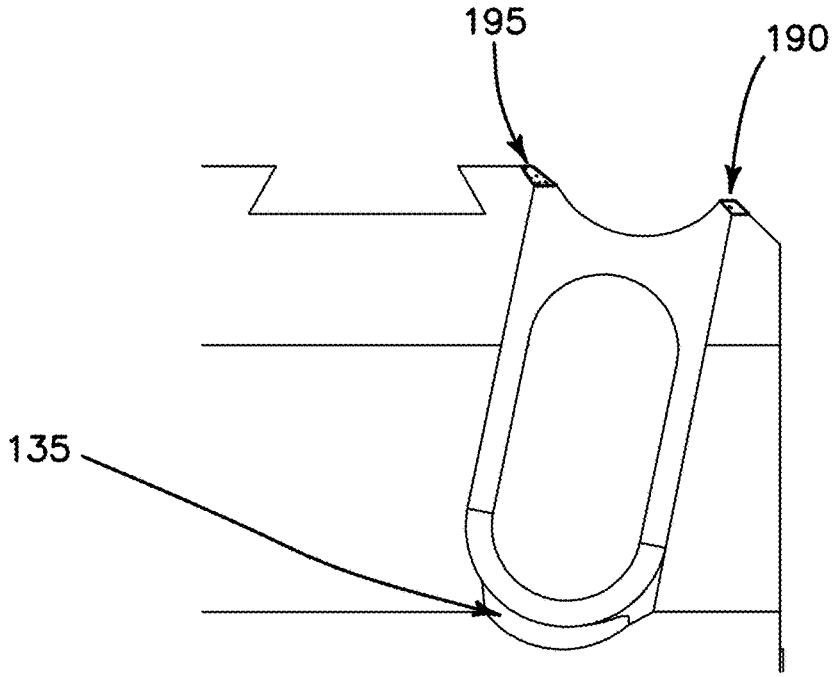

FIGS. 7A and 7B show views of a compensator height offset between a front edge 190 and rear edge 195 of upper compensator port 200 provides several benefits. In one embodiment, the front edge 190 and rear edge 195 are beveled to create additional efficiencies. A first benefit is that the height offset increases efficiency and effectiveness of the compensator 130. A second benefit is that the height offset eliminates a hard edge thus preventing the firearm from snagging on objects. A third benefit is that the height offset forces gases through a Prandtl-Meyer Expansion Fan at the front of the gun thereby pulling the muzzle forward to further reduce rearward recoil.

Figure 8A:
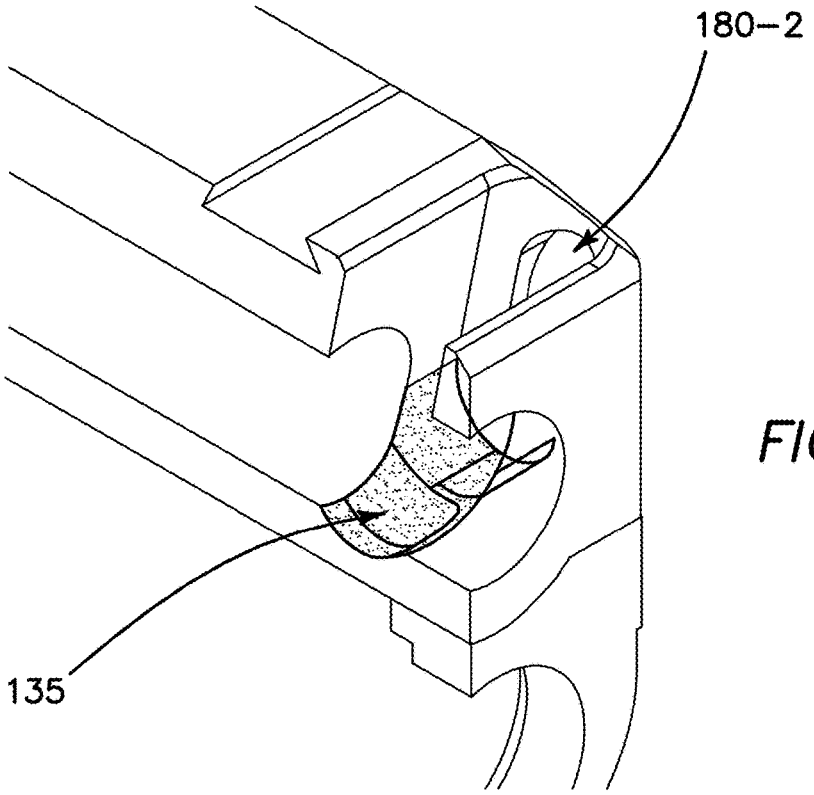
FIGS. 8A and 8B illustrate views of a compensator bottom according to the embodiments of the present invention.
Figure 8B:
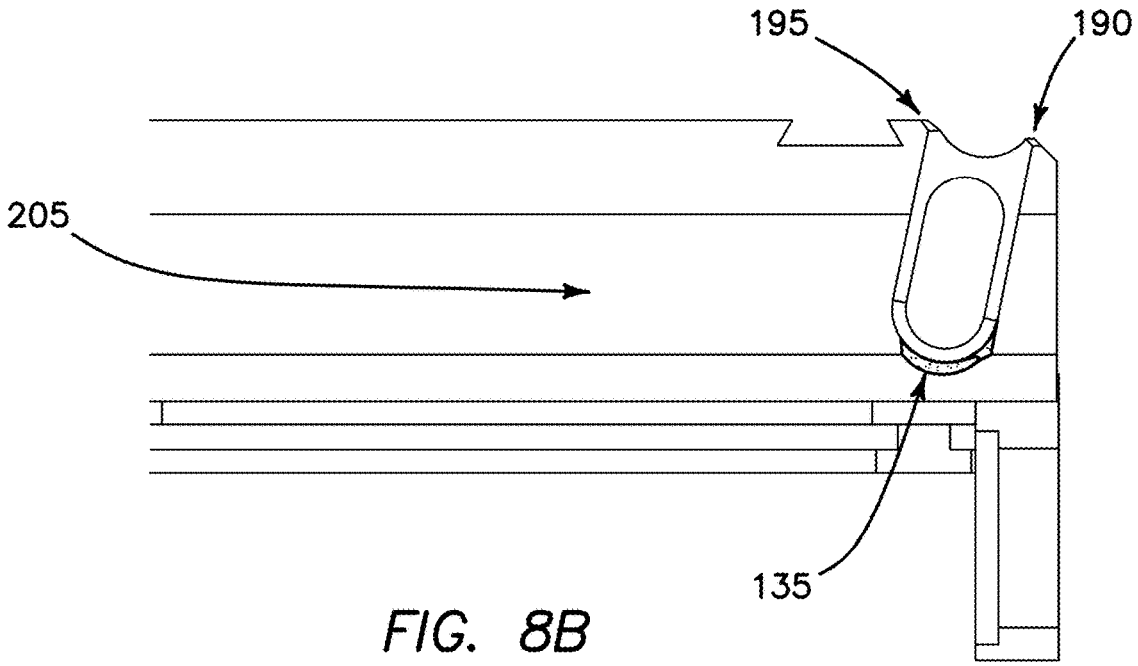

FIGS. 8A and 8B show views of a compensator bottom 135 according to the embodiments of the present invention. As shown, the bottom 135 of the compensator 130 is below the bottommost surface of the barrel bore 205 providing more efficiency and accuracy. In one embodiment, the bottom 135 is formed by a ball-mill cut.

Figure 9A:
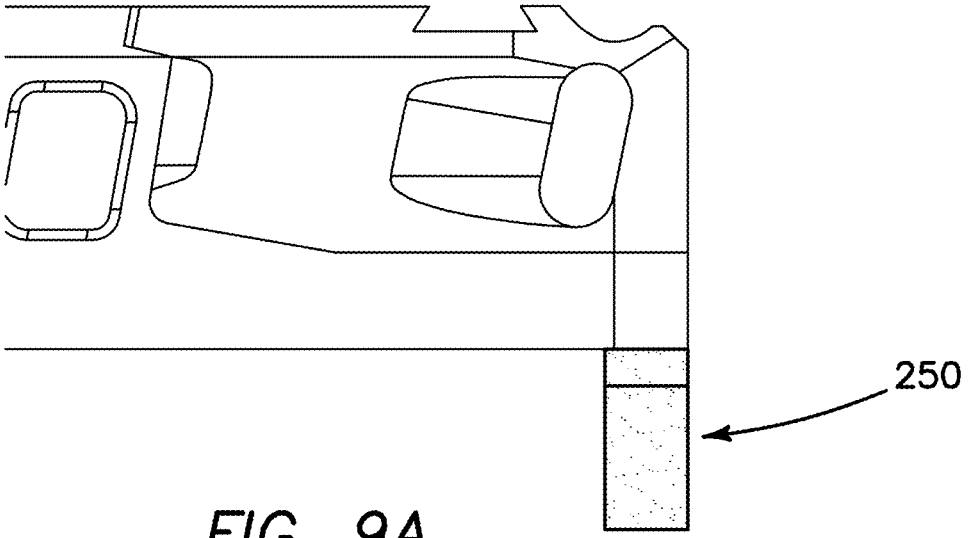
FIGS. 9A and 9B illustrate views of a nose ring according to the embodiments of the present invention.
Figure 9B:
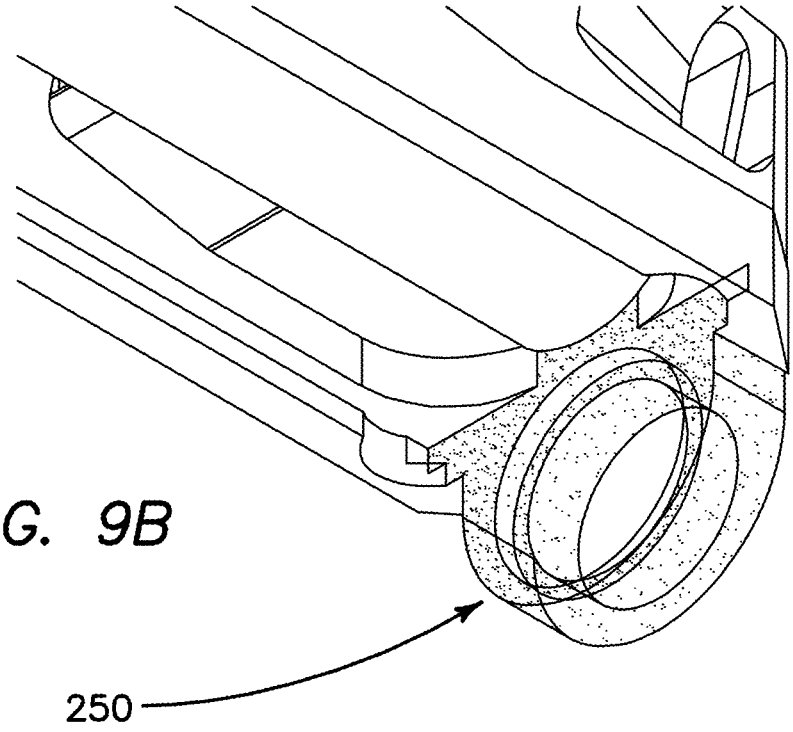
Figure 10A:
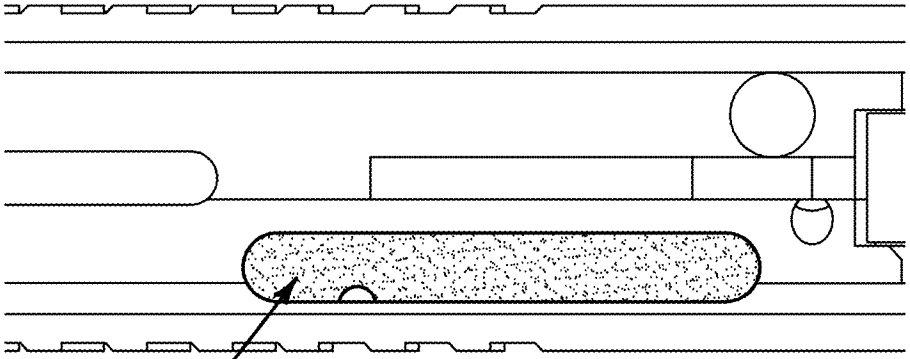
FIGS. 10A and 10B illustrate views of a mass-reducing cutout according to the embodiments of the present invention.
Figure 10B:
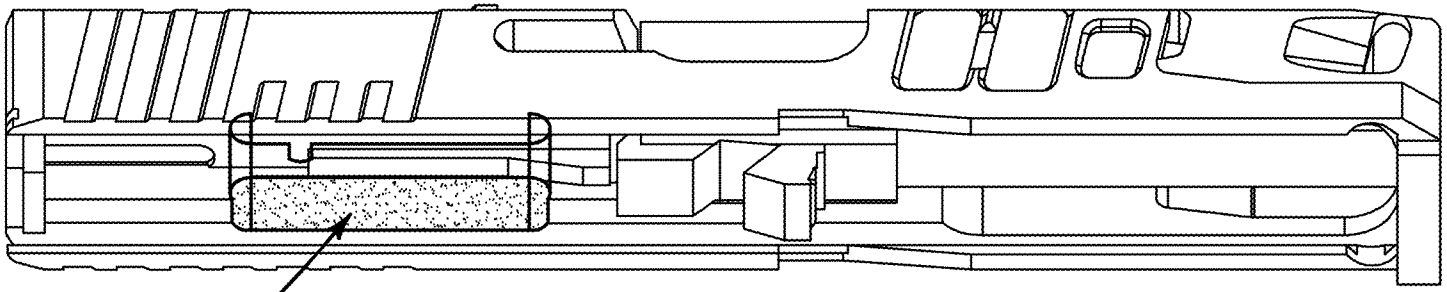

FIGS. 9A and 9B show views of a nose ring 250 according to the embodiments of the present invention. FIGS. 10A and 10B show views of a mass-reducing cutout 255 according to the embodiments of the present invention. The cutout 255 serves to decrease reciprocating mass associated with the recoil.

Figure 11:
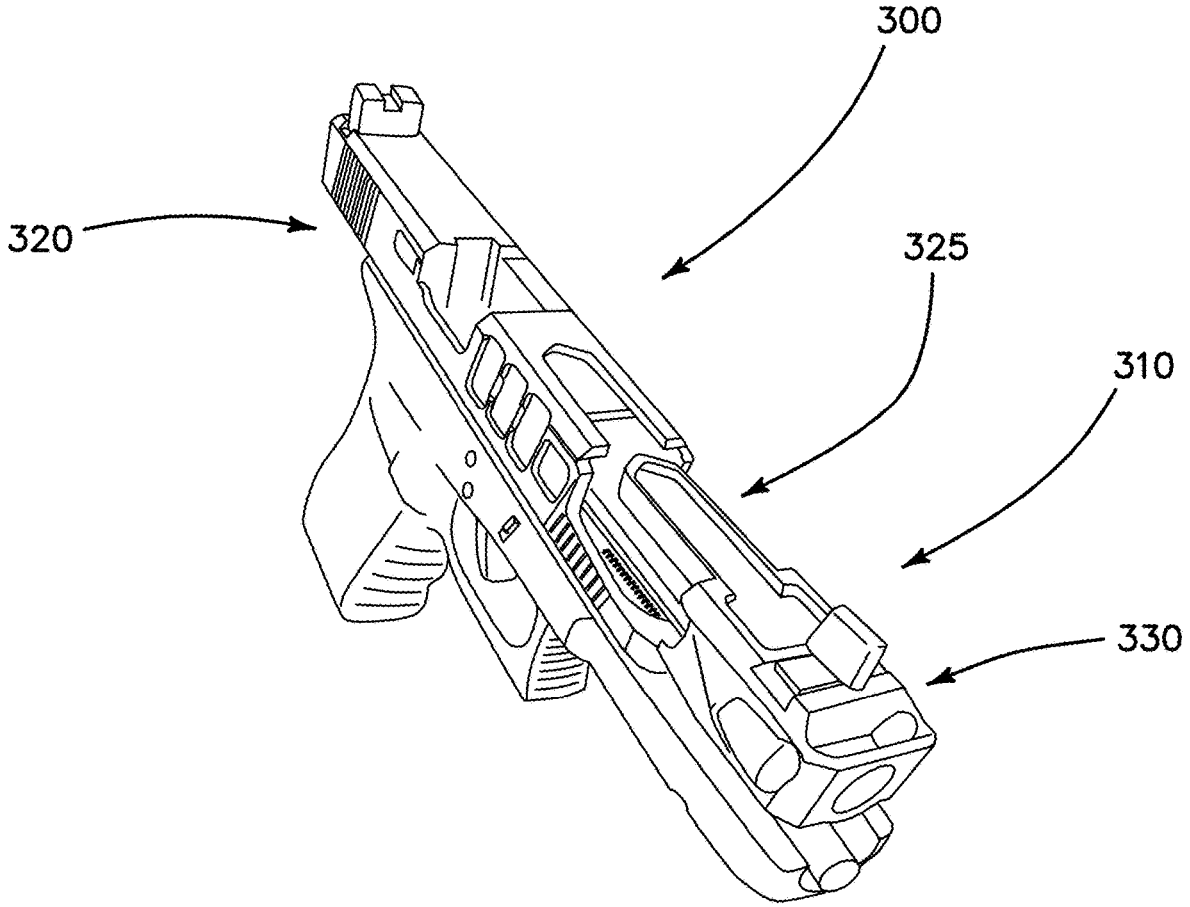
FIG. 11 illustrates a view of a firearm with the barrel and compensator unit integrated therein according to the embodiments of the present invention.

FIG. 11 shows a view of a firearm 300 with the barrel and compensator unit 310 integrated therewith according to the embodiments of the present invention. As shown, the barrel and compensator unit 310 mates with a slide assembly 320 and includes a barrel 325 and compensator 330.

Figure 12:
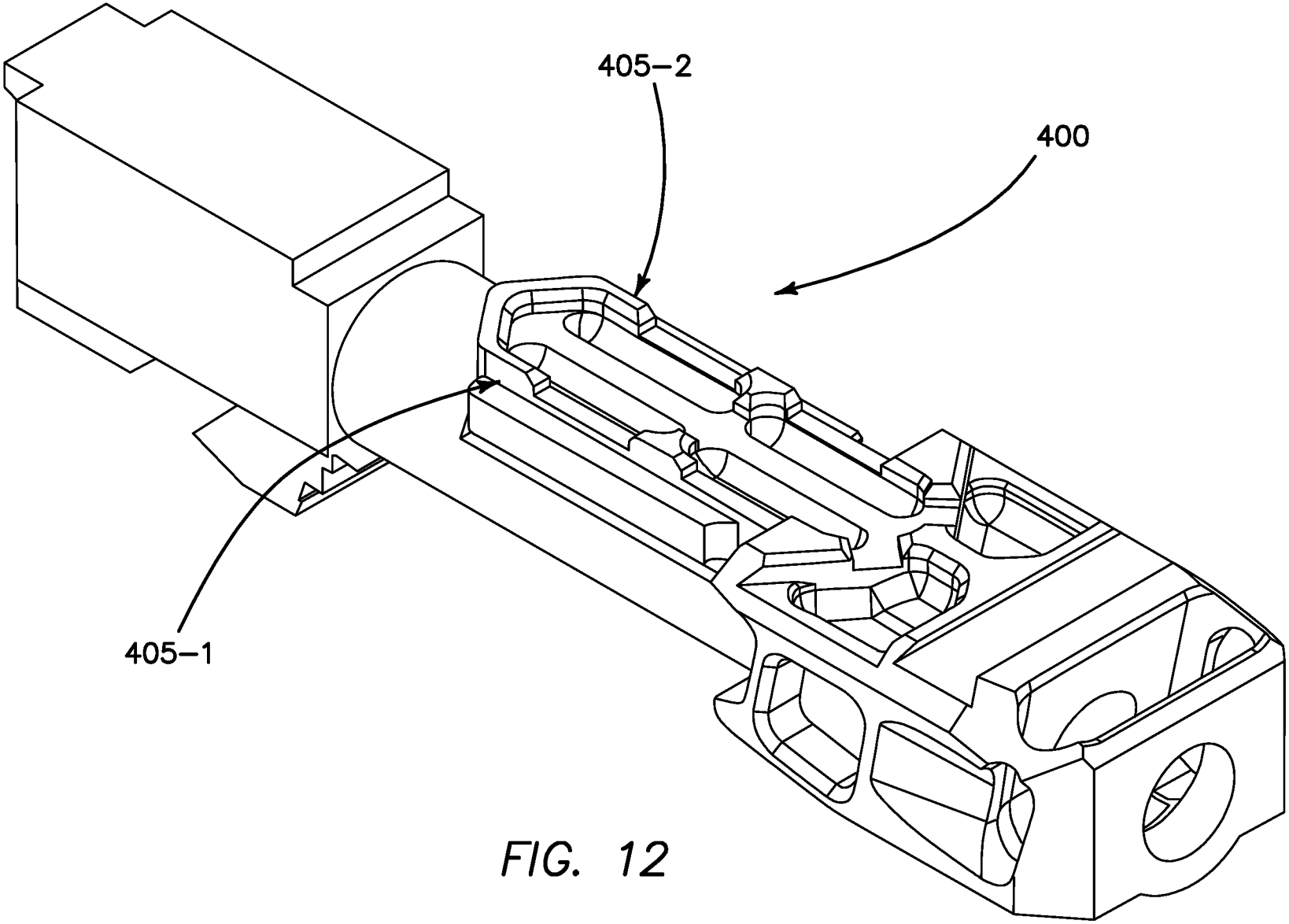
FIG. 12 illustrates an upper view of an alternative barrel/compensator assembly according to the embodiments of the present invention.
Figure 13:
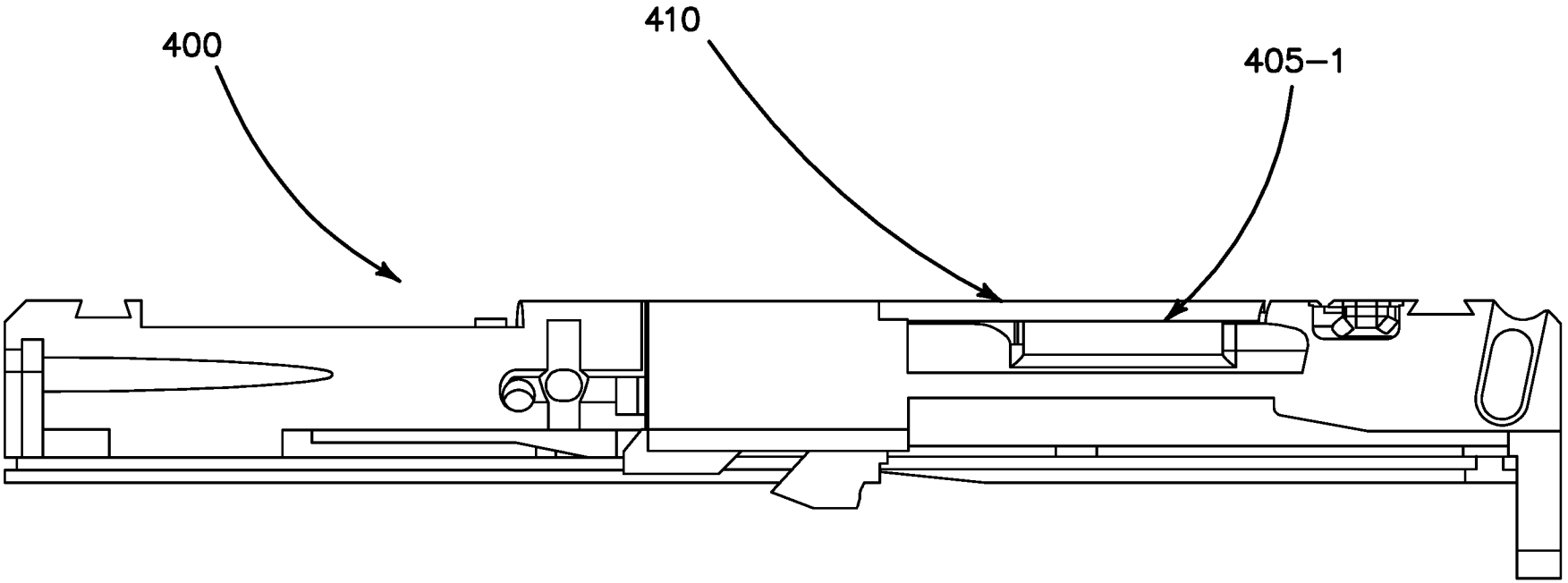
FIG. 13 illustrates a side view of an alternative barrel/compensator assembly with slide according to the embodiments of the present invention.

FIG. 12 shows an upper view of an alternative barrel/compensator assembly 400. With this embodiment, the barrel/compensator assembly 400 includes a pair of longitudinal slide rails 405-1, 405-2 configured to act as contact interfaces with corresponding portions of a slide 410 (shown in FIGS. 13 and 14). The slide 410 is configured to translate along the longitudinal rails 405-1, 405-2 as needed. FIG. 13 shows a side view of the barrel/compensator assembly 400 with the slide 410 in position according to the embodiments of the present invention.

Figure 14:
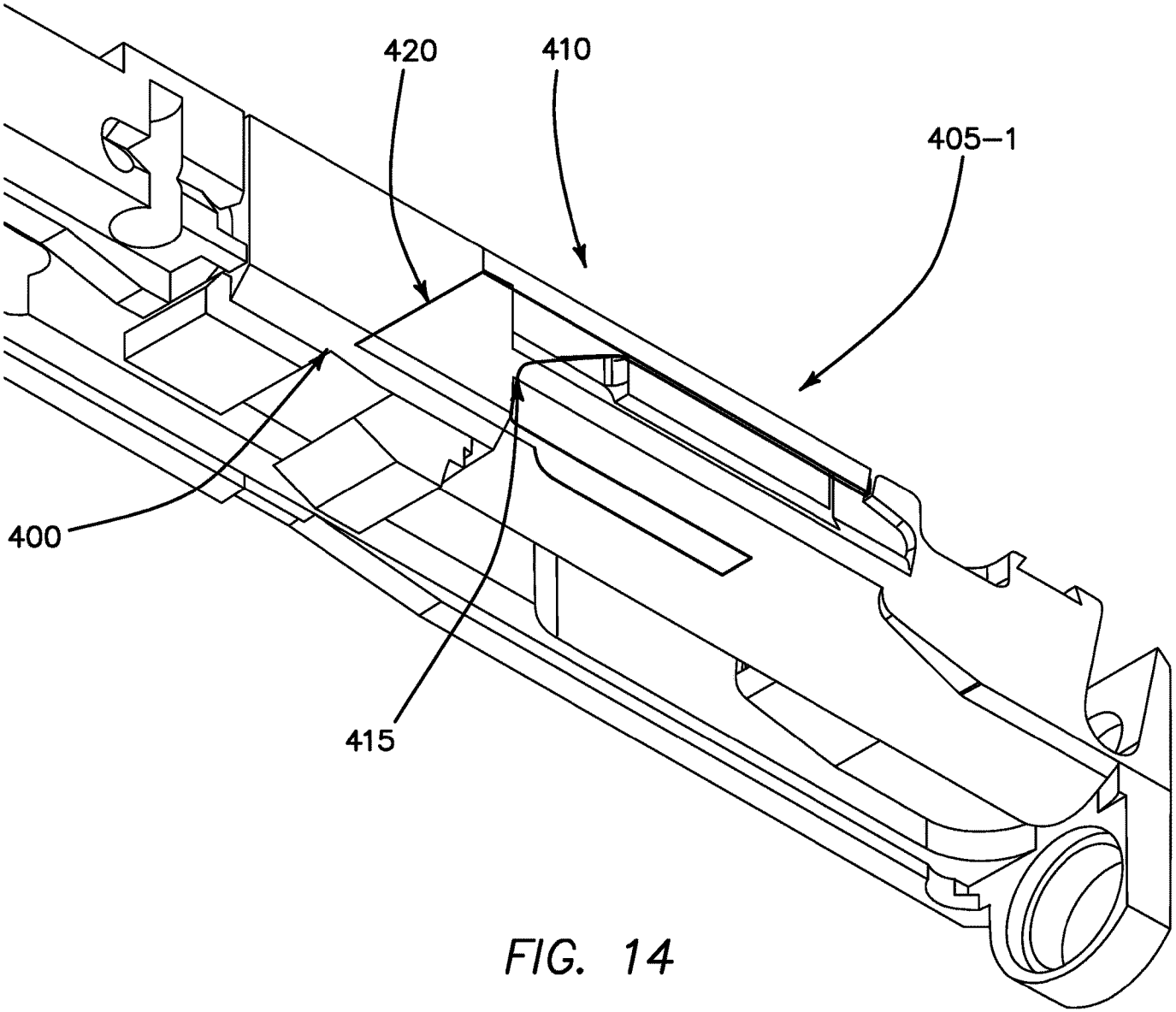
FIG. 14 illustrates an underside of an alternative barrel/compensator assembly with slide according to the embodiments of the present invention.

FIG. 14 shows a view of an underside of the barrel/compensator assembly 400 and slide 410 according to the embodiments of the present invention. As highlighted, a total interface area 415 includes the contact points (i.e., interface portions) along the longitudinal rails 405-1, 405-2 and a square area 420 proximate thereto. The total interface area 415 represents the contact portion between the barrel/compensator assembly 400 and the slide 410.

Although the invention has been described in detail with reference to several embodiments, additional variations and modifications exist within the scope and spirit of the invention as described and defined in the following claims.

I claim:

1. A firearm comprising:

a slide assembly;

a compensator and barrel combination removably attached to said slide assembly;

said compensator and barrel combination including a pair of spaced rails running longitudinally therealong, said pair of spaced rails each having an upper surface positioned and configured to slidably contact oppositely positioned underside portions of said slide assembly, said underside portions of said slide assembly running longitudinally along said slide assembly; and wherein when said slide assembly is moved, said underside portions of said slide assembly translate along said pair of spaced rails.

2. The firearm of claim 1 wherein said pair of spaced rails are positioned approximately midway along a length of said compensator and barrel combination.

3. The firearm of claim 1 wherein said pair of spaced rails are positioned below an upper surface of said compensator of said compensator and barrel combination.

* * * * *